US006089836A

United States Patent [19]

Seo

[11] Patent Number: 6,089,836

[45] Date of Patent: Jul. 18, 2000

[54] LINEAR COMPRESSOR

[75] Inventor: Kwang Ha Seo, Koonpo, Rep. of Korea

[73] Assignee: LG Electronics Inc., Rep. of Korea

[21] Appl. No.: 09/229,036

[22] Filed: Jan. 12, 1999

[30] Foreign Application Priority Data

Jan. 12, 1998 [KR] Rep. of Korea ..... 98-571

[51] Int. Cl.[7] ..... F04B 17/04

[52] U.S. Cl. ..... 417/417; 417/415; 417/416

[58] Field of Search ..... 417/415, 416, 417/417, 902

[56] References Cited

U.S. PATENT DOCUMENTS

| | | | |
|---|---|---|---|
| 3,788,778 | 1/1974 | Miller | 417/417 |
| 4,057,979 | 11/1977 | Abell et al. | 62/469 |
| 4,477,229 | 10/1984 | Kropiwnicki et al. | 417/53 |
| 4,911,620 | 3/1990 | Richardson, Jr. et al. | 418/55.5 |
| 5,275,542 | 1/1994 | Terauchi | 417/417 |
| 5,993,178 | 11/1999 | Park et al. | 417/545 |

*Primary Examiner*—Teresa Walberg
*Assistant Examiner*—Vinod D Patel
*Attorney, Agent, or Firm*—Ostrolenk, Faber, Gerb & Soffen, LLP

[57] ABSTRACT

A linear compressor according to the present invention introduces a direct suction system by extending a gas suction pipe to an inside of a piston of a compressor unit to thereby minimize gas suction loss of the linear compressor and also reducing manufacturing costs and includes elastic support means necessary for vertically disposing the linear compressor in order to more effectively apply the direct suction system. According to the present invention, there is provided a compressor including a predetermined-shaped hermetic vessel, a compressor unit disposed in the hermetic vessel without having mufflers, a gas suction pipe extendedly formed to an inside of a piston of the compressor unit, an oil supply means for supplying oil into a cylinder of the compressor unit and elastic support means provided at upper and lower parts of the hermetic vessel for elastically supporting the compressor unit.

5 Claims, 4 Drawing Sheets

LINEAR COMPRESSOR

BACKGROUND OF THE INVENTION

1. Field of the Invention

The present invention relates to a linear compressor, and more particularly to a linear compressor capable of minimizing gas suction loss of the compressor and reduce manufacturing costs by adopting a direct gas suction system in which a gas suction pipe is extendedly provided to an inner side of a piston of a compressor unit.

2. Description of the Conventional Art

FIG. 1 is a cross-sectional diagram illustrating an example of a conventional compressor. As shown therein, the compressor is mainly provided with a predetermined-shaped hermetic vessel 1 in which a gas suction pipe 2 is provided at one side thereof, a compressor unit 10 disposed in the hermetic vessel 1 in a horizontal direction, an oil supply means 3 disposed out of the compressor unit 10 at a bottom part of the hermetic vessel 1 and a plurality of springs 4 provided between a lower part of the unit 10 and the hermetic vessel 1 for elastically supporting the the compressor unit 10.

More specifically, the compressor unit 10 includes a cylinder 11 in which an oil path 11*a* is provided, a cover 12 coupled with an end side of the cylinder 11 and having a through hole 12*a* formed in a center portion thereof, first and second lamination 13, 14 disposed at an outer surface of the cylinder 11 having a predetermined distance to each other, a valve assembly 15 coupled with the other end side of the cylinder 11 by covering a hole thereof, a movable unit 16, to which a magnet 19 is attached, disposed between the first and second lamination 13, 14 for linearly reciprocating and having an opening 16*a* in a center portion thereof, a piston 17 formed with the movable unit 16 as a single unit and reciprocating in the cylinder 11, first and second springs 20, 21 elastically supporting the reciprocation of the piston 17, a cylindrical first muffler 22 of which an end portion is fixedly attached to the through hole 12*a* of the cover 12 and a second muffler 23 of which an end portion is fixedly attached to the opening 16*a* of the movable unit 16 and the other end portion is formed by being extended into the piston 17 for a predetermined length.

Here, numerals 24 and 25 are an oil supply pipe and an oil discharge pipe, respectively.

In such linear compressor, when a power is applied to the compressor unit 10, the movable unit 16 linearly reciprocates between the first lamination 13 and the second lamination 14 and also the piston 17 linearly reciprocates in the cylinder 11 by virtue of the reciprocation of the movable unit 16. Then, in accordance with the reciprocation of the piston 17 in the cylinder 11, a refrigerant gas flowed into the hermetic vessel 1 is sucked into a compression chamber of the cylinder 11 through a refrigerant flow channel 17*a* provided in the piston 17 and compressed therein, and the compressed refrigerant gas is exhausted through the valve assembly 15, the above process being repeatedly performed.

Here, a general refrigerating cycle unit of the linear compressor is provided such that a gas supplied from an evaporator is flowed into the hermetic vessel 1 through the gas suction pipe 2 communicated with the one end side of the vessel 1 and a part of the gas is directly flowed via the first and second mufflers 22, 23 and a remainder first fills the hermetic vessel 1, then is sucked into the compression chamber of the cylinder 11 through the first and second mufflers 22, 23 by pressure difference during the reciprocation of the piston 17 and compressed and exhausted by the compressive reciprocation of the piston 17.

Further, in the reciprocation of the piston 17, oil O filled in the bottom part of the hermetic vessel 1 passes through the oil supply means 3 and then oil supply pipe 24, and is discharged through the oil discharge pipe 25 after lubricating a portion between the piston 17 and the cylinder 11. In the conventional linear compressor, the gas is partly sucked into the compression chamber of the cylinder 11 through the first and second mufflers 22, 23 after filling the hermetic vessel 1.

However, since the one end portion of the gas suction pipe 2 is located between the hermetic vessel 1 and the compressor unit 10 and thus an atmosphere in the hermetic vessel 1 is heated by, for example, a motor, the gas flowed into the gas suction pipe 2 is also heated in certain degree. Therefore, the gas sucked into the compression chamber of the cylinder 11 through the first and second mufflers 22, 23 has been already preheated and thereby gas suction loss is incurred in accordance with of the gas volume ratio, which results in deterioration of the suction efficiency of the compressor.

SUMMARY OF THE INVENTION

Accordingly, the present invention is directed to a linear compressor which obviates the problems and disadvantages due to the conventional art.

An object of the present invention is to provide a linear compressor that introduces a direct suction system by extending a gas suction pipe to an inside of a piston of a compressor unit to thereby minimize gas suction loss of the linear compressor and also reducing manufacturing costs.

To achieve these and other advantages and in accordance with the purpose of the present invention, as embodied and broadly described, there is provided a horizontal linear compressor which includes a predetermined-shaped hermetic vessel, a compressor unit horizontally disposed in the hermetic vessel without having mufflers, a gas suction pipe extendedly formed to an inside of a piston of the compressor unit, an oil supply means for supplying oil into a cylinder of the compressor unit and a plurality of springs provided between a lower part of the compressor unit and the hermetic vessel for elastically supporting the compressor unit.

Further, there is provided a vertical linear compressor which includes a predetermined-shaped hermetic vessel, a compressor unit vertically disposed in the hermetic vessel without having mufflers, a gas suction pipe extendedly formed to an inside of a piston of the compressor unit, an oil supply means for supplying oil into a cylinder of the compressor unit and elastic support means provided at upper and lower parts of the hermetic vessel for elastically supporting the compressor unit.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 1:
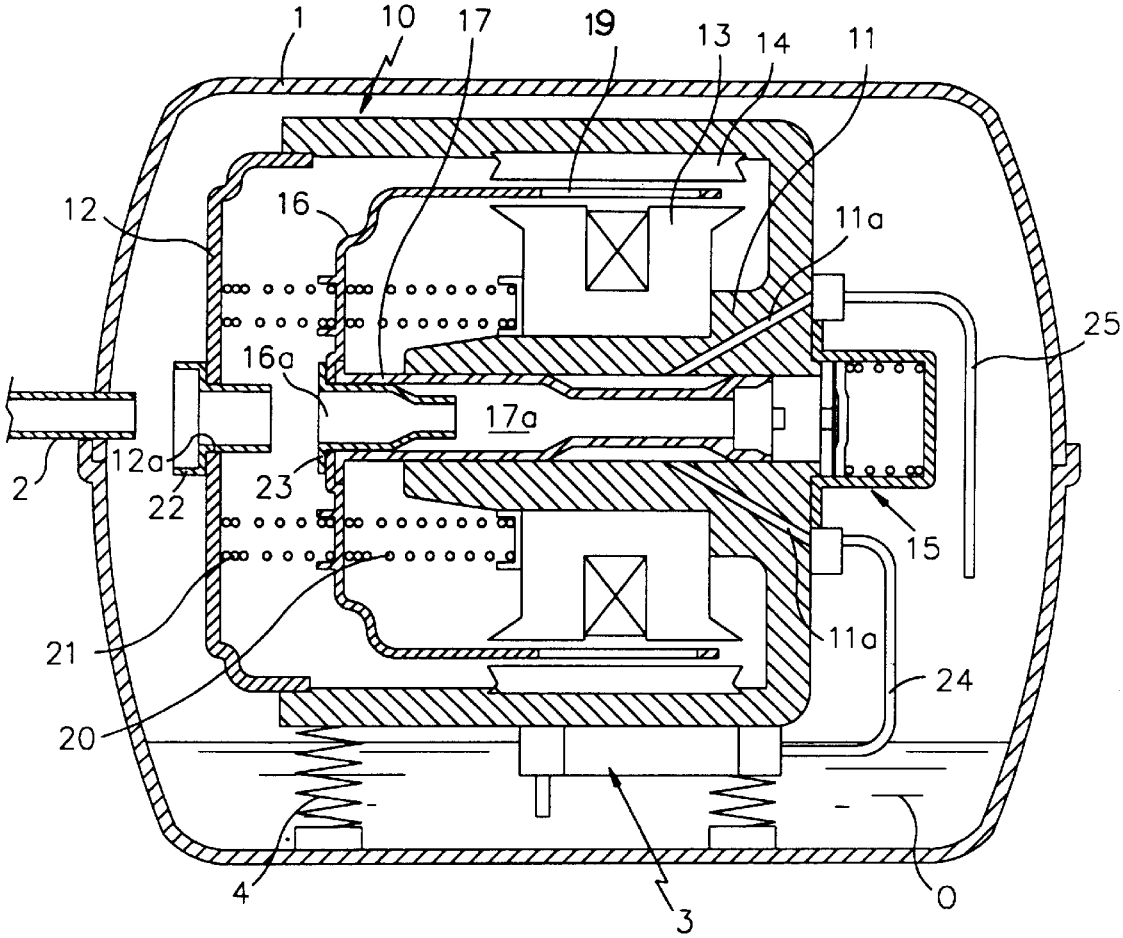
FIG. 1 BACKGROUND ART
FIG. 1 is a cross-sectional diagram of an example of a conventional linear compressor.
Figure 2:
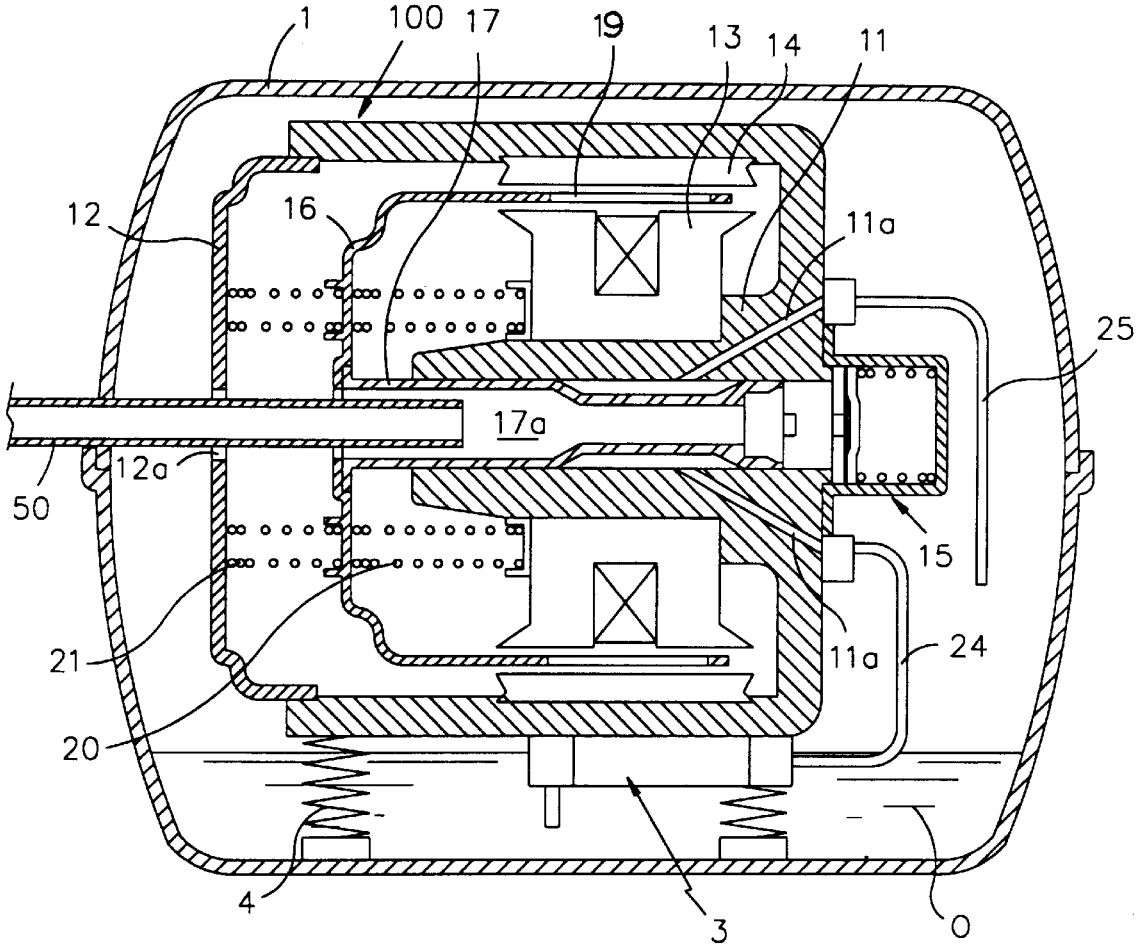
FIG. 2 is a cross-sectional diagram illustrating a linear compressor according to an embodiment of the present invention.

FIG. 2 illustrates a linear compressor according to the present invention. Here, the components which are the same as those of the conventional art are labelled with the same reference numbers.

As shown therein, in the linear compressor according to a first embodiment of the present invention, a gas suction pipe 50 is extended for a predetermined length to the inside of the piston 17 of the compressor unit 100. In other words, the mufflers provided in the compressor unit of the conventional linear compressor are not applied in the present invention, and there is introduced a direct suction system wherein the gas suction pipe 50 is extendedly formed to the inside of the piston 17, so that a gas is prevented from being preheated by the heat generated by the motor in the hermetic vessel 1 before flowing into the compression chamber of the cylinder 11.

In such linear compressor, when power is applied to the compressor unit 100, the movable unit 16 linearly reciprocates between the first and second laminations 13, 14 and also the piston 17 linearly reciprocates in the cylinder 11 in accordance with the reciprocation of the movable unit 16. As the piston 17 reciprocates in the cylinder 11, the gas is directly flowed into the compression chamber of the cylinder 11 through the gas suction pipe 50 and compressed therein and the compressed gas is exhausted through the valve assembly 15, the above process being repeatedly performed.

Here, since the gas suction pipe 50 is extended to the inside of the piston 70 of the compressor unit 100, the gas passing through the gas suction pipe 50 is not preheated in the hermetic vessel 1, but directly flowed into the compression chamber of the cylinder 11 through the refrigerant flow channel 17*a* of the piston 17 and therefore the volume of the gas does not expand so that relatively large amount of the gas can be flowed into the compression chamber, compressed and exhausted.

Figure 3:
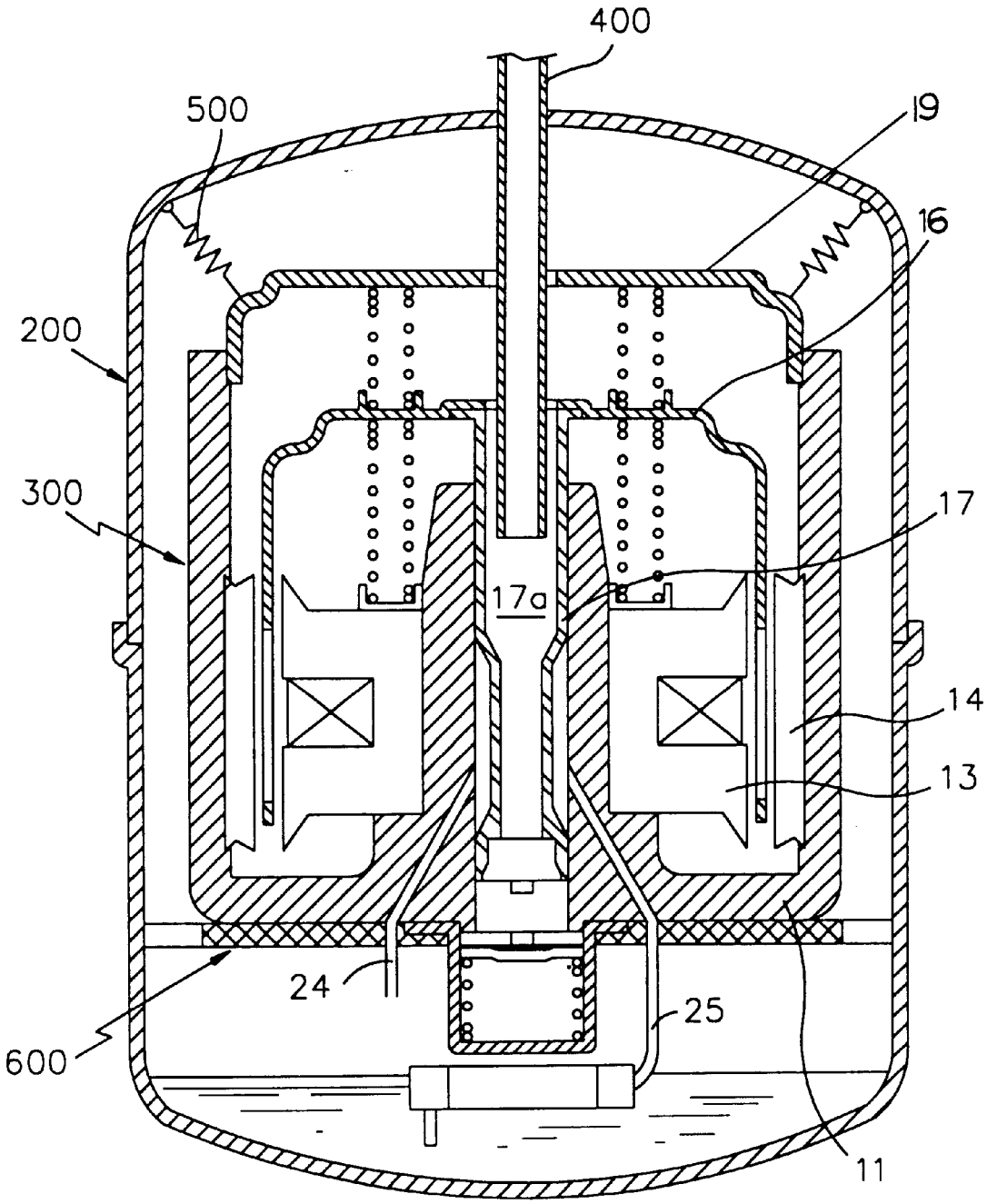
FIG. 3 is a cross-sectional diagram illustrating a linear compressor according to another embodiment of the present invention.

While, FIG. 3 illustrates the linear compressor according to a second embodiment of the present invention. Here, it is to be noted that the linear compressor of the second embodiment adopts a vertical-type compressor to more effectively accomplish the direct suction system applied to the first embodiment according to the present invention.

As shown therein, the linear compressor according to the second embodiment of the present invention is provided with a compressor unit 300 vertically disposed in a predetermined-shaped hermetic vessel 200, a gas suction pipe 400 extendedly provided to an inside of the piston 17 of the compressor unit 300 and elastic support means 500, 600 respectively disposed at upper and lower parts of the hermetic vessel 200 for elastically supporting the compressor unit 300. That is, the linear compressor according to the second embodiment is formed by vertically disposing the compressor unit 300 and accordingly providing the elastic support means 500, 600 for supporting the compressor unit 300 as well as introducing the direct suction system.

Here, the structure of the linear compressor according to the present invention is identical to the conventional art except for the vertical disposition of the compressor unit 300, the gas suction pipe 400 being extended to the inside of the piston 17 of the compressor unit 300 and the elastic support means 500, 600 for the supporting the compressor unit 300. Therefore, the detailed description of the structural parts of the linear compressor identical to the conventional art will be omitted.

In the elastic support means 500, 600 for supporting the compressor unit 300, an elastic support means is a plurality of tensile springs 500 for hanging the compressor unit 300 to upper marginal portions of the hermetic vessel 200 to thereby support the compressor unit 300, and the other elastic support means is an elastic support assembly 600 for fixing the compressor unit 300 to thereby radially support the unit 300 thereon.

Figure 4:
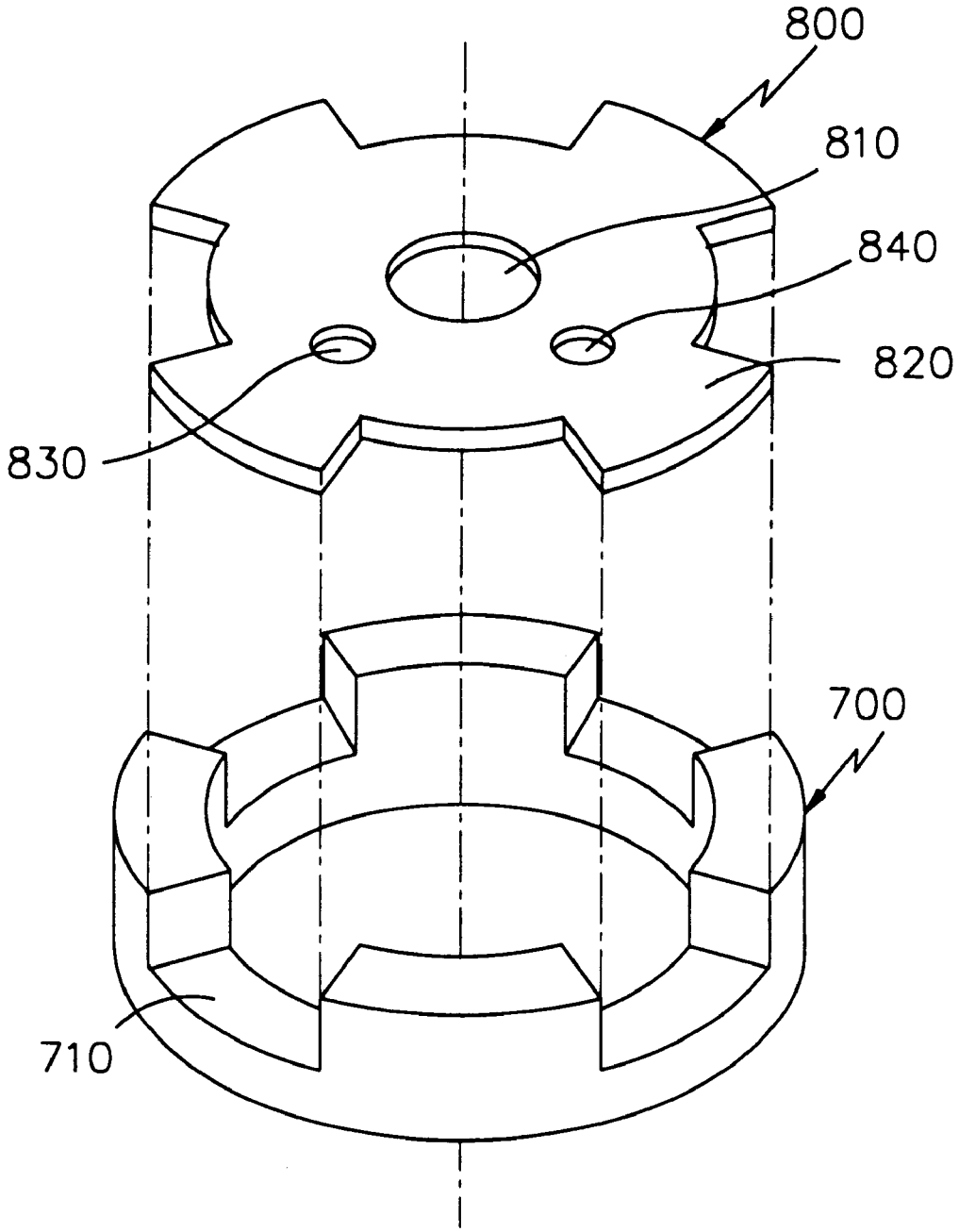
FIG. 4 is a perspective view of an elastic support means according to the present invention.

FIG. 4 illustrates the elastic support assembly 600 of the elastic support means according to the present invention.

As shown therein, the elastic support assembly 600 consists of a ringshaped spring bracket 700 fixed to a portion of an inner circumferential surface of the hermetic vessel 200 and a ringshaped plate spring 800 assembled on a predetermined portion of the spring bracket 700 and for securely fixing the compressor unit 300 thereon. Further, a plurality of insertion grooves 710 are formed on an upper surface of the spring bracket 700 at equal distances, a through hole 810 is formed in a center portion of the plate spring 800 to receive the valve assembly 15 of the compressor unit 300, and a plurality of elastic portions 820 are protruded from an outer circumferential surface of the plate spring 800 at equal distances, the elastic portions 820 being inserted into the corresponding insertion grooves 710 of the spring bracket 700 and elastically supporting the compressor unit 300.

In addition, in the plate spring 800 there are formed a couple of holes 830, 840, the hole 830 receiving the oil supply pipe 24 for supplying the oil O into the cylinder 11 and the other hole 840 receiving the oil discharge pipe 25 for discharging the oil O out of the cylinder 11.

In the thusly provided linear compressor according to the second embodiment of the present invention, when the power is applied to the linear compressor unit 300, the movable unit 16 vertically reciprocates between the first and second laminations 13, 14 and the piston 17 also vertically reciprocates in the cylinder 11 in accordance with the vertical reciprocation of the movable unit 16. In accordance with the reciprocation of the piston 17 in the cylinder 11, a gas passing through the gas suction pipe 400 and then the refrigerant flow channel 17*a* of the piston 17 is sucked into the compression chamber of the cylinder 11 and compressed therein, and the compressed gas is exhausted through the valve assembly 15, the above process being repeatedly performed. Here, since the gas suction pipe 400 is extendedly formed to the inside of the piston 17 as in the first embodiment of the present invention, the gas which passes through the gas suction pipe 400 is, without being preheated therein, directly flowed into the compression chamber of the cylinder 11 through the refrigerant flow channel 17*a* of the piston 17 and the volume of the gas passing therethrough does not expand so that large amount of the refrigerant gas can be flowed into the compression chamber, and compressed and exhausted therein. Further, being vertically disposed, vertical vibrations of the compressor unit 300 can be sufficiently absorbed by the tensile springs 500 and the elastic support assembly 600 which are provided at the upper and lower parts, respectively, of the compressor unit 300.

As described above, the linear compressor has advantages of minimizing the gas suction loss by preventing the gas from being preheated before flowing into the compression chamber and reducing the manufacturing costs, since the gas suction pipe is provided by being extended to the inside of the piston.

In addition, such gas suction pipe can also be applied to the linear compressor in which the compressor unit is vertically disposed by providing the elastic support means.

It will be apparent to those skilled in the art that various modifications and variations can be made in the linear compressor of the present invention without departing from the spirit or scope of the invention. Thus, it is intended that the present invention cover the modifications and variations of this invention provided they come within the scope of the appended claims and their equivalents.

What is claimed is:

1. A linear compressor, comprising:

a predetermined-shaped hermetic vessel;

a compressor unit vertically disposed in the hermetic vessel and consisting of a cylinder in which an oil path is provided, a cover coupled with an end side of the cylinder and having a through hole formed in a center portion thereof, first and second lamination disposed at an outer surface of the cylinder having a predetermined distance to each other, a valve assembly coupled with the other end side of the cylinder by covering a hole provided therein, a movable unit to which a magnet is attached and linearly reciprocating between the first and second lamination, a piston formed with the movable unit as a single unit, first and second springs for elastically supporting the reciprocation of the piston;

an oil supply means for supplying oil filled in a bottom part of the hermetic vessel into the compressor unit;

a gas suction pipe extending thru the hermetic vessel and in to an inside of the the piston of the compressor unit; and elastic support means provided at upper and lower parts of the hermetic vessel for elastically supporting the compressor unit.

2. The linear compressor according to claim 1, wherein the elastic support means comprises:

a plurality of tensile springs for hanging the compressor unit to upper marginal portions of the hermetic vessel to thereby support the compressor unit; and an elastic support assembly fixed to an lower portion of an inner circumferential surface of the hermetic vessel and radially supporting the compressor unit by securely fixing the compressor unit.

3. The linear compressor according to claim 2, wherein the elastic support assembly comprises:

a ringshaped spring bracket fixed to the inner circumferential surface of the hermetic vessel; and a ringshaped plate spring securely fixed on the spring bracket and elastically supporting the compressor unit.

4. The linear compressor according to claim 3, wherein a plurality of insertion grooves are formed on an upper surface of the spring bracket at equal distances, a through hole is formed in a center portion of the plate spring to receive the valve assembly of the compressor unit, a plurality of elastic portions are protruded from an outer circumferential surface of the plate spring at equal distances to be inserted into the corresponding insertion grooves of the spring bracket and a couple of holes are formed in the plate spring to receive an oil supply pipe for supplying the oil into the cylinder and an oil discharge pipe for discharging the oil out of the cylinder, respectively.

5. A linear compressor, comprising:

a predetermined-shaped hermetic vessel;

a compressor unit horizontally disposed in the hermetic vessel and consisting of a cylinder in which an oil path is provided, a cover coupled with an end side of the cylinder and having a through hole formed in a center portion thereof, first and second lamination disposed at an outer surface of the cylinder having a predetermined distance to each other, a valve assembly coupled with the other end side of the cylinder by covering a hole provided therein, a movable unit to which a magnet is attached and linearly reciprocating between the first and second lamination, a piston formed with the movable unit as a single unit, first and second springs for elastically supporting the reciprocation of the piston;

an oil supply means for supplying oil filled in a bottom part of the hermetic vessel into the compressor unit;

a plurality of springs provided between a lower part of the compressor unit and the hermetic vessel for elastically supporting the compressor unit; and a gas suction pipe extending thru the hermetic vessel and in to an inside of the the piston of the compressor unit.

* * * * *